US009776701B2

(12) United States Patent
Pietsch

(10) Patent No.: US 9,776,701 B2
(45) Date of Patent: Oct. 3, 2017

(54) BOAT SPEED MINIMISATION SYSTEM

(71) Applicant: Howard Charles Pietsch, Ringwood North (AU)

(72) Inventor: Howard Charles Pietsch, Ringwood North (AU)

( * ) Notice: Subject to any disclaimer, the term of this patent is extended or adjusted under 35 U.S.C. 154(b) by 40 days.

(21) Appl. No.: 14/409,933

(22) PCT Filed: Feb. 22, 2013

(86) PCT No.: PCT/AU2013/000166
§ 371 (c)(1),
(2) Date: Dec. 19, 2014

(87) PCT Pub. No.: WO2013/188901
PCT Pub. Date: Dec. 27, 2013

(65) Prior Publication Data

US 2015/0191235 A1 Jul. 9, 2015

(30) Foreign Application Priority Data

Jun. 20, 2012 (AU) ..... 2012902594

(51) Int. Cl.
*B63H 20/34* (2006.01)
*B63H 25/02* (2006.01)
(Continued)

(52) U.S. Cl.
CPC ..... *B63H 20/34* (2013.01); *B63H 25/02* (2013.01); *B63H 25/44* (2013.01); *B63H 25/48* (2013.01); *B63H 2025/045* (2013.01)

(58) Field of Classification Search
CPC ..... B63H 25/00; B63H 25/44; B63H 25/48; B63H 25/50; B63H 25/52
See application file for complete search history.

(56) References Cited

U.S. PATENT DOCUMENTS 1,257,298 A 2/1918 Westendarp
1,576,237 A 3/1926 Dawson
(Continued)

FOREIGN PATENT DOCUMENTS

CA 1310548 C 11/1992

OTHER PUBLICATIONS

Written Opinion of the International Searching Authority dated Dec. 20, 2014 for corresponding International Application No. PCT/AU2013/000166, filed Feb. 22, 2013.
(Continued)

*Primary Examiner* — John R Olszewski
*Assistant Examiner* — Tommy Worden
(74) *Attorney, Agent, or Firm* — David D. Brush

(57) ABSTRACT

A trolling plate which, together with a supporting and deployment mechanism, is fixed to and strutted from an outboard motor without the need for engineering modifications or the use special tools; said trolling plate being pivotably deployable into the water in the zone immediately downstream of the propeller of the outboard motor to substantially block the efflux from said propeller and thereby reduce its propulsive effort; said deployment being effected in a universally variable way by means of a suitable actuator; control means of said actuator and/or said deployment mechanism incorporating means to permit the immediate retraction of said trolling plate should it impact an obstruction or should the power of said outboard motor suddenly be increased.

13 Claims, 11 Drawing Sheets

(51) Int. Cl.

| | |
|---|---|
| ***B63H 25/44*** | (2006.01) |
| ***B63H 25/48*** | (2006.01) |
| ***B63H 25/04*** | (2006.01) |

(56) References Cited

U.S. PATENT DOCUMENTS 2,050,336 A 8/1936 Karasinski
2,078,179 A 4/1937 Johnson et al.
2,256,898 A 9/1941 Ehmke
2,654,336 A 10/1953 Katzung et al.
2,719,503 A 10/1955 Smith
2,787,974 A * 4/1957 Johuson ..... B63H 25/50 114/145 A
2,984,203 A 5/1961 Canning
3,117,548 A 1/1964 Rasmussen
3,136,280 A 6/1964 Bergum
3,209,716 A 10/1965 Hartley
3,965,838 A 6/1976 Uht
4,026,231 A * 5/1977 Fedorko ..... B63H 25/48 114/145 A
4,069,611 A * 1/1978 Dusich ..... A01K 91/08 43/43.12
4,549,498 A 10/1985 Meyer et al.
5,005,507 A * 4/1991 Dyer ..... B63H 20/34 114/145 A
5,127,353 A * 7/1992 Wieser ..... B63H 20/34 114/145 A
5,305,701 A * 4/1994 Wilson ..... B63H 25/44 114/145 A
5,493,990 A * 2/1996 Dyer ..... B63B 39/061 114/145 A
5,645,009 A 7/1997 Lexau
5,711,241 A * 1/1998 Dyer ..... B63H 25/50 114/145 A
5,715,768 A 2/1998 Anderson
5,924,378 A * 7/1999 Peterson ..... B63H 20/34 114/145 A
5,975,969 A * 11/1999 White ..... B63H 5/14 114/274
6,073,570 A 6/2000 Stirtz
6,161,492 A * 12/2000 Dyer ..... B63H 25/44 114/145 A
6,220,195 B1 4/2001 Crews
6,397,772 B1 * 6/2002 Christensen ..... B63H 25/44 114/145 A
8,043,135 B1 * 10/2011 Corn ..... B63B 17/00 440/66
8,474,391 B1 * 7/2013 Hagen ..... B63H 25/44 114/145 A
2004/0207247 A1 * 10/2004 Jackson ..... E21C 25/16 299/85.1
2005/0252434 A1 * 11/2005 Dyer ..... B63H 20/34 114/145 A

OTHER PUBLICATIONS

International Search Report dated Apr. 22, 2013 for corresponding International Application No. PCT/AU2013/000166 filed Feb. 22, 2013.

* cited by examiner

BOAT SPEED MINIMISATION SYSTEM

CROSS-REFERENCE TO RELATED APPLICATIONS

This Application is a Section 371 National Stage Application of International Application No. PCT/AU2013/000166, filed Feb. 22, 2013, which is incorporated by reference in its entirety and published as WO 2013/188901 on Dec. 27, 2013, in English.

This invention relates generally to methods of reducing the speed of small boats used for fishing by trolling. In particular, it relates to a method of reducing the speed of small, outboard motor-propelled boats to dead slow by blocking the flow of water through the propeller and thereby reducing its propulsive effort.

In fishing for some marine species, particularly pisces and some cephalopoda, trolling may be used. Trolling is defined as drawing a baited hook or lure through the water in a way to simulate movement of the natural prey of the target species. Such movement can be jerky, achieved through the use of a rod, or at a steady speed. Where the hook or lure is deployed from a boat, speeds are generally steady and in the range 0.35 to 1.5 meters per second. In a boat propelled by an outboard motor, even where the motor is idled, the resultant speed may prove to be too great. Further, some outboard motors tend to become over-cooled when operated at sustained idle, which results, over time, in adverse effects upon engine condition. To reduce the speed of a boat below that resulting from idling its propelling outboard motor or to permit an outboard motor to be operated at higher power without an increase in boat speed, a trolling plate is employed.

The use of trolling plates with outboard motors employed to propel boats during trolling is well known in the art. Trolling plates normally comprise a flat or more or less flat plate able to be deployed into the zone immediately downstream of the propeller of an outboard motor, together with support and deployment means. By substantially blocking the water efflux from the propeller, the trolling plate reduces the propulsive effort generated. Preferably, the deployment means permit the trolling plate to be readily retracted from its fully deployed position to a position of neutral effect and incrementally between the two. In its simplest form, as taught by Johnson et al in U.S. Pat. No. 2,078,179, a fixed trolling plate is slideably engaged with the anti-ventilation plate of an outboard motor and locked into position by means of a spring latch. When not required, the latch is released and the trolling plate removed. In another example taught by Canning in U.S. Pat. No. 2,984,203, a fixed trolling plate is supported by a bracket assembly clamped to the lower housing of an outboard motor. In another example, taught by Dawson in U.S. Pat. No. 1,576,237, a trolling plate is pivotally supported and screw means incorporated into its pivotal support means are made to engage detents provided in a fixed quadrant. By disengaging the screw means from the detented quadrant, the angular displacement of the trolling plate is able to be adjusted and then locked in position by re-engaging the screw means with the quadrant. In another example taught by Katzung et al in U.S. Pat. No. 2,654,336, a trolling plate is made to be pivotally displaceable about a vertical axis. The trolling plate is manually displaced as required between the free running and trolling positions and locked in either position by a spring-operated latch engaging apertures in a supporting plate. In other examples taught by Bergum in U.S. Pat. No. 3,136,280, Hartley in U.S. Pat. No. 3,209,716, Rasmussen in U.S. Pat. No. 3,117,548, Smith in U.S. Pat. No. 2,719,503, Karasinski in U.S. Pat. No. 2,050,336, Ehmke in U.S. Pat. No. 2,256,898 and Stirtz in U.S. Pat. No. 6,073,570, a trolling plate is urged into the trolling position by various embodiments of spring means, the trolling plates being displaced by water pressure out of the trolling position when the outboard motors to which the examples are fitted are increased in power. Bergum teaches the use of a downwardly deployed trolling plate pivotally supported from the anti-ventilation plate and a sprung breaking-knee mechanism to urge the trolling plate towards its deployed position. Hartley teaches the use of an upwardly deployed trolling plate pivotally supported from a supporting bar fixed to the skeg of an outboard motor and urged into the trolling position by rat trap-type spring means incorporated into the pivot mechanism. Rasmussen teaches the use of a trolling plate downwardly deployed upon parallelogram arms pivotally fixed to the lower leg of an outboard motor and urged into the trolling position by tension spring means acting upon the parallelogram arms. Smith teaches the use of a downwardly deployed trolling plate pivotally supported from the anti-ventilation plate of an outboard motor and urged into the trolling position by positionally adjustable tension spring means. Karasinski teaches the use of a downwardly deployed trolling plate pivotally supported from the anti-ventilation plate of an outboard motor and urged into the trolling position by rat trap-type spring means incorporated into the pivot mechanism. Ehmke teaches the use of a trolling plate in the form of two complementary parts pivotally supported at their adjacent edges upon a common, vertically arranged hinge, the two parts being urged into the trolling position by rat trap-type spring means made integral with the hinge means or by compression spring means between the two parts of said trolling plate. Stirtz teaches the use of a downwardly deployed trolling plate pivotally supported from the anti-ventilation plate of an outboard motor and allowed to descend to the trolling position under the influence of gravitational force. An adjustable release mechanism utilising a ramp and roller structure allows the trolling plate to rotate to the non-trolling position when water pressure against the trolling plate exceeds a predetermined threshold. A lanyard may be pulled to release the deployed trolling plate, permitting it to be displaced to the non-trolling position, or to release a latch at the non-trolling position to allow the trolling plate to descend to its deployed position.

In U.S. Pat. No. 3,965,838 and U.S. Pat. No. 4,549,498, Uht and Meyer et al, respectively, teach the use of a downwardly deployed trolling plate pivotally supported from the anti-ventilation plate of an outboard motor and urged into the trolling position, respectively, by rat trap-type spring means incorporated into the pivot mechanism or by gravitational force. Sprung locking means locate the trolling plate in its deployed position and a lever operated by a lanyard is used to release the locking means and displace the trolling plate to its retracted position against the urging of the spring means or gravitational force. Meyer et al alternatively propose a trolling plate displaced by a hydraulic actuator supported from a specially provided, upright support structure. In U.S. Pat. No. 5,127,353, Weiser teaches the use of a downwardly deployed trolling plate pivotally supported from the anti-ventilation plate of an outboard motor and urged into the trolling position by rat trap-type spring means incorporated into the pivot mechanism. In its retracted position, the trolling plate also acts as a hydrofoil. A shear pin mechanism incorporated into latch means secures the trolling plate in its deployed position, but permits release of the trolling plate under excessive load. A latch operating handle is operable directly or via a lanyard to release the latch means, and permit the trolling plate to be displaced from its trolling position. In U.S. Pat. No. 5,711,241, Dyer teaches the use of a downwardly deployed trolling plate pivotally supported from the anti-ventilation plate of an outboard motor and urged into the trolling position by rat trap-type spring means incorporated into the pivot mechanism. Rollers engaging detents in a curved track formed on the base of the trolling plate lock the trolling plate in its deployed and retracted positions. In operation, the trolling plate is unlocked by tension applied to an arm via a lanyard and deployed by the spring means to the trolling position. Acceleration of the outboard motor engine raises the trolling plate to be locked in its retracted position. In U.S. Pat. No. 5,715,768 and U.S. Pat. No. 6,220,195, Anderson and Crews, respectively, teach the use of a trolling plate system similar in arrangement to that of Dyer, but with a locking bar engaging detents in a curved track formed on the base of the trolling plate to lock the trolling plate in its deployed and retracted positions, a lanyard and lever arrangement being employed to raise the trolling plate. In U.S. Pat. No. 1,257,298, Westendarp teaches the use on a boat having an inboard engine of a composite rudder that may be opened out to catch part of the water flow from the propeller and reverse its direction of flow. In U.S. Pat. Nos. 4,026,231 and 5,305,701, Fedorko and Wilson, respectively, teach the use of a downwardly deployed trolling plate pivotally supported directly from the anti-ventilation plate of an outboard motor or from support means fixed to the anti-ventilation plate and urged into or retracted from the trolling position by means of hydraulic or electromechanical actuators. The actuators obviously possess the capacity to permit incremental positioning of the trolling plate anywhere between the trolling and retracted positions, as does the hydraulic actuator of Meyer et al.

In the prior art examples cited, some employ a fixed trolling plate or one that is manually deployed or positionally adjusted. In the majority, a trolling plate is urged into the deployed position by spring means and deflected to the retracted position by increased water flow or by tension applied to a lanyard. Where an actuator is employed to displace a trolling plate to its deployed or retracted positions, it is pivotally supported from a separate, specially provided supporting structure or from a pivot incorporated into an inboard-outboard drive leg. All require engineering modification of the outboard motor or inboard-outboard drive leg.

The object of the present invention is to provide a trolling plate system able to be readily retrofitted to an outboard motor and having minimal or no requirement for modification or the use of special tools; the invention allowing a boat operator to set engine power during trolling and then precisely vary the speed of the boat to suit a target species.

According to the present invention, a trolling plate system is positioned at the trailing edge of the anti-ventilation plate of an outboard motor, pivotally supported from a supporting plate fixed to said anti-ventilation plate. Said supporting plate is fixed to said anti-ventilation plate with suitable clamping means, while conventional attachment fastenings are optionally employed. Said trolling plate incorporates at its inner (pivot) end a lever arm acted upon by a suitable actuator, said actuator allowing said trolling plate to be displaced with universal variability into any position between its fully deployed and fully retracted positions. Said actuator is, in turn, supported by said supporting plate or from a supporting band installed on the mid section of said outboard motor. Various means are employed for the powering and control of said actuators, including override provisions to protect said trolling plate from inadvertent overloading.

The various aspects of the present invention will be more readily understood by reference to the following description of preferred embodiments given in relation to the accompanying drawings in which.

Figure 1:
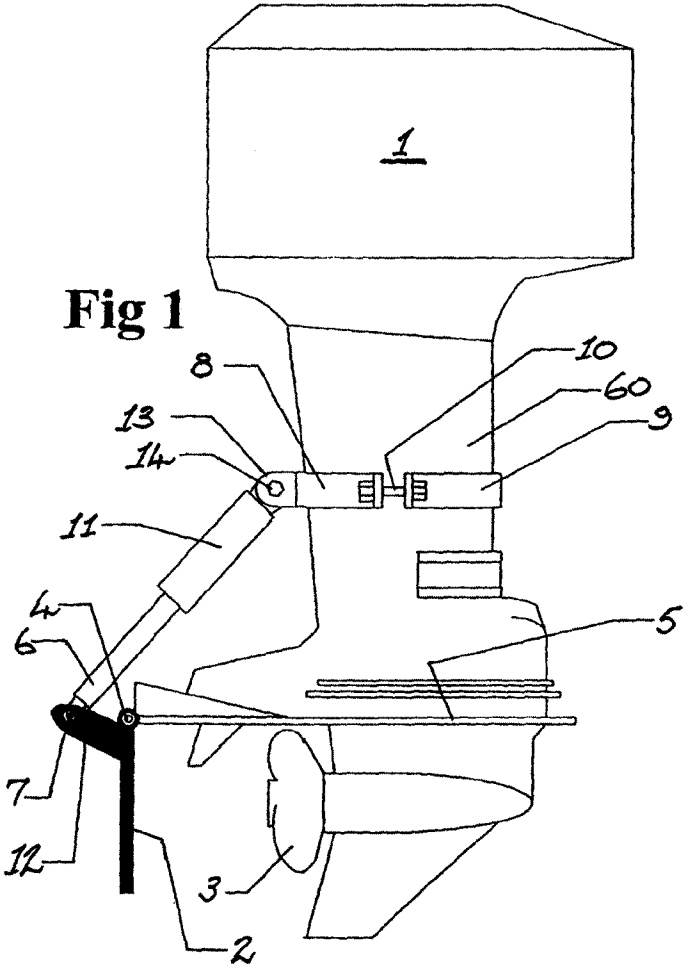
FIG. 1 is a side view of an outboard motor fitted with one embodiment of the trolling plate system of the present invention.

With reference to FIG. 1, an outboard motor 1 is fitted with a trolling plate 2. Said trolling plate is pivotally supported on pivot 4 fixed to the trailing edge of the anti-ventilation plate 5 of said outboard motor. Said trolling plate is able to be deployed into the zone immediately downstream of propeller 3 and is of sufficient surface area to substantially block the water efflux from said propeller, thereby reducing its propulsive effort. Lever arm 12 fixed to the inner (pivot) end of said trolling plate is pivotally connected by pivot 7 to rod 6 of actuator 11. The upper end of said actuator is pivotally connected to lug 13 of supporting band 8, 9 by pivot 14. Parts 8, 9 of said supporting band are clamped around mid section 60 of said outboard motor by clamping bolt 10. Extension or retraction of rod 6 by said actuator acts to deploy or retract said trolling plate. In the preferred embodiment, pivot 4 supporting said trolling plate is formed on an attachment plate generally of the arrangement depicted in FIG. 9, said attachment plate being fixed to said anti-ventilation plate by various means. In an alternative embodiment (not shown), pivot 4 is fixed with conventional fastenings directly to the trailing edge of said anti-ventilation plate.

Figure 2:
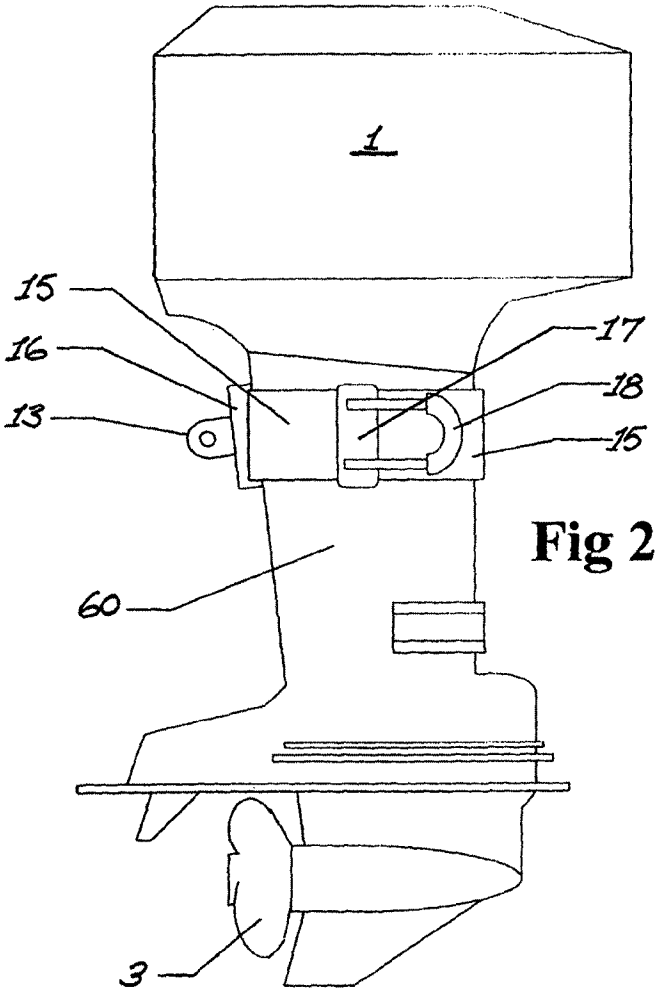
FIG. 2 is a side view of the outboard motor fitted with alternative means to support an actuator of the trolling plate system of FIG. 1.

With additional reference to FIG. 2, said supporting band is made in composite form comprising principally a thick band 15 of braided high-strength polymer filaments tightened around mid section 60 of said outboard motor by ratchet means 17 actuated by operation of handle 18. Such ratchet means are well known in the art and are commonly employed in industrial applications, including for the tightening of load tie-down straps. Said band passes through block 16 and secures it in place on said outboard motor mid section. Actuators (not shown) of various forms are pivotally attached to lug 13 formed on said block.

Where a said supporting band is fixed to an outboard motor mid section, discrete pieces or a continuous strip of a suitable soft, compliant material is place beneath said band to ensure the generation of a high level of frictional attachment to the surface of said mid section.

Figure 3:
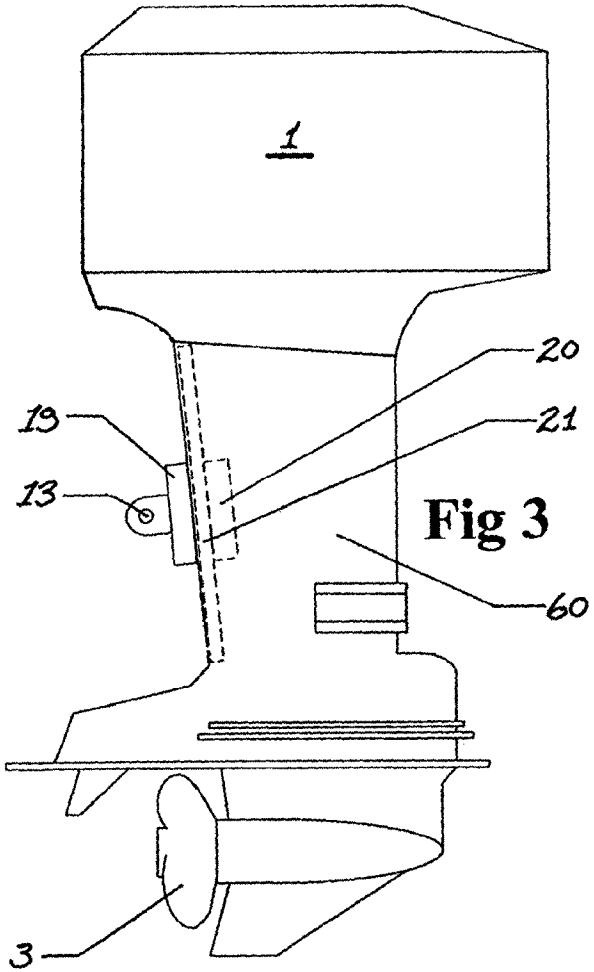
FIG. 3 is a side view of the outboard motor fitted with other alternative means to support an actuator of said trolling plate system of FIG. 1.

With reference to FIG. 3, outer block 19 is fixed to the trailing edge of mid section 60 of outboard motor 1 by fastenings (not shown) passing through the thickness of the shell of said mid section to engage inner block 20. To better support operational forces, strengthening plate 21 is optionally placed between said blocks on the interior surface of said shell of said mid section. Said blocks and said strengthening plate are preferably shaped to conform to the shaping of abutting surfaces. Actuators (not shown) of various forms are pivotally attached to lug 13 formed on said outer block.

Figure 4:
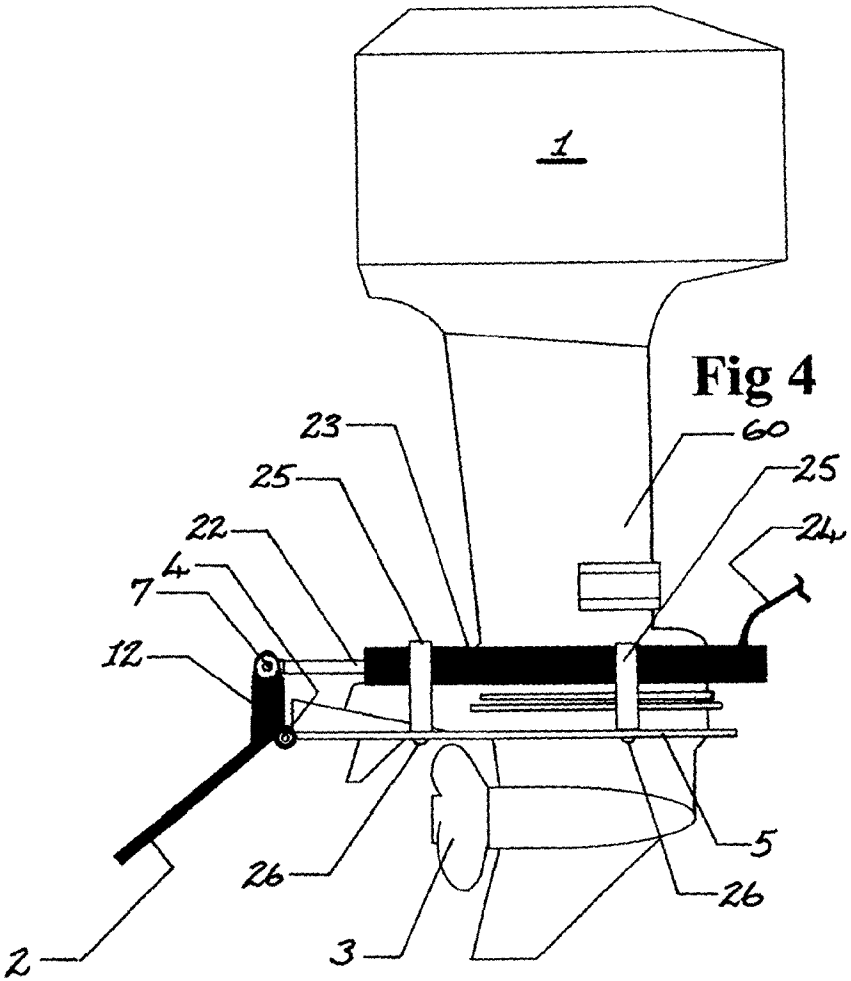
FIG. 4 is a side view of the outboard motor fitted with an alternative embodiment of the trolling plate system of the present invention.

With reference to FIG. 4, an outboard motor 1 is fitted with a trolling plate 2. Said trolling plate is pivotally supported on pivot 4 fixed to the trailing edge of the anti-ventilation plate 5 of said outboard motor. Lever arm 12 fixed to the inner (pivot) end of said trolling plate is pivotally connected by pivot 7 to rod 22 of actuator 23. In the preferred embodiment, pivot 4 supporting said trolling plate is formed on an attachment plate generally of the arrangement depicted in FIG. 9, said attachment plate being fixed to said anti-ventilation plate by various means. In an alternative embodiment (not shown), pivot 4 is fixed with conventional fastenings directly to the trailing edge of said anti-ventilation plate. Said actuator is supported from said anti-ventilation plate by pillars 25. In the preferred embodiment (not shown), said pillars are fixed to a common bar and said bar is fixed to said anti-ventilation plate by suitable clamping means. Said clamping means take the form of fixed jaws positioned over the side of said anti-ventilation plate and secured to it with grub screws or other easily removable fastenings; or moveable jaws positioned over the side of said anti-ventilation plate and tightened by screw means. In an alternative embodiment (as depicted in the figure), said pillars are fixed to said anti-ventilation plate by conventional fastenings 26. The free end of said lever arm is slotted to permit pivot 7 to describe an arc without applying bending forces to rod 22. Electrical power or a flow of hydraulic fluid is supplied to said actuator via connection 24.

Figure 5:
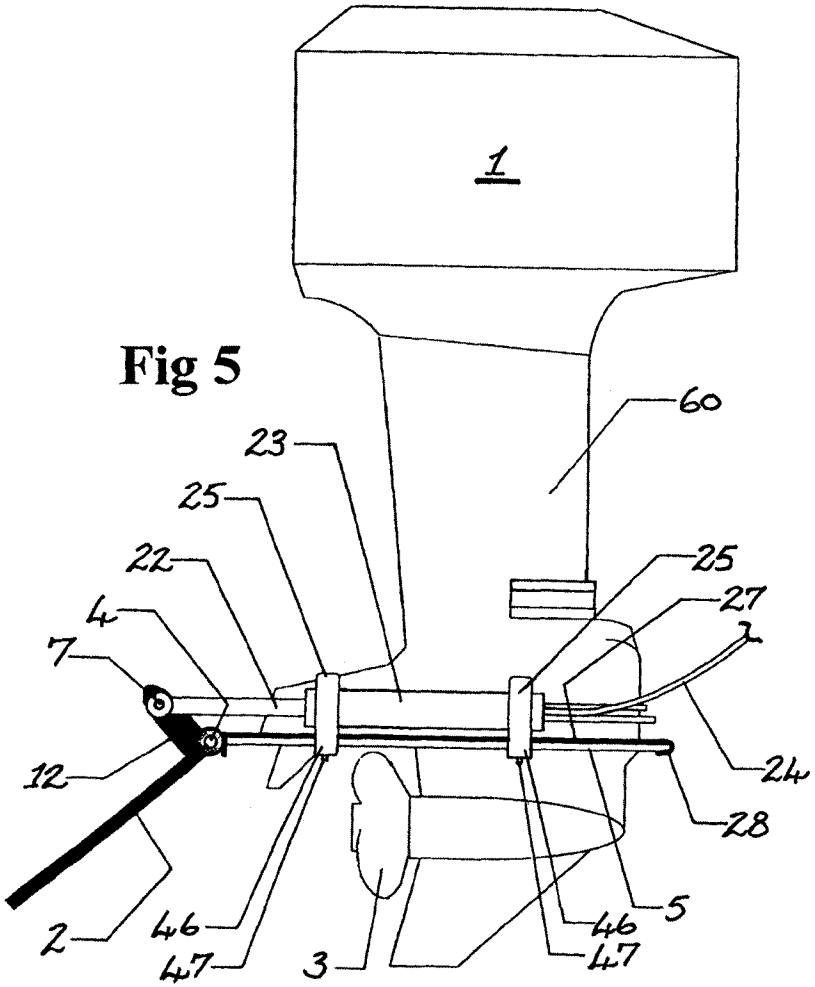
FIG. 5 is a side view of the outboard motor fitted with another alternative embodiment of the trolling plate system of the present invention.

With reference to FIG. 5, an outboard motor 1 is fitted with a trolling plate 2. Said trolling plate is pivotally supported on pivot 4 located at the trailing edge of the anti-ventilation plate 5, said pivot being formed on the trailing edge of attachment plate 27. Said attachment plate is superimposed upon said anti-ventilation plate and is generally U-shaped in planform, with arms passing to either side at the bottom of the mid section of said outboard motor. Lever arm 12 fixed to the inner (pivot) end of said trolling plate is pivotally connected by pivot 7 to rod 22 of actuator 23. Said actuator is supported from said attachment plate by pillars 25. Said pillars are provided at their lower ends with fixed jaws 46 (only plain outer surfaces visible) which enclose edge zones of said attachment plate and said anti-ventilation plate and are secured in place by the tightening of grub screws 47 or other suitable fastening means. In an alternative embodiment (not shown), said pillars are provided at their lower ends with moveable jaws which enclose edge zones of said attachment plate and said anti-ventilation plate and are secured in place by the tightening of suitable screw means. The other side of said attachment plate (not shown) is fixed to said anti-ventilation plate by fixed or moveable-jaw clamping means of the form described. The free end of said lever arm is slotted to permit pivot 7 to describe an arc without applying bending forces to rod 22. Electrical power or a flow of hydraulic fluid is supplied to said actuator via connection 24. In the preferred embodiment, said attachment plate is shaped to conform to the shape of the upper surfaces of said anti-ventilation plate.

Figure 7:
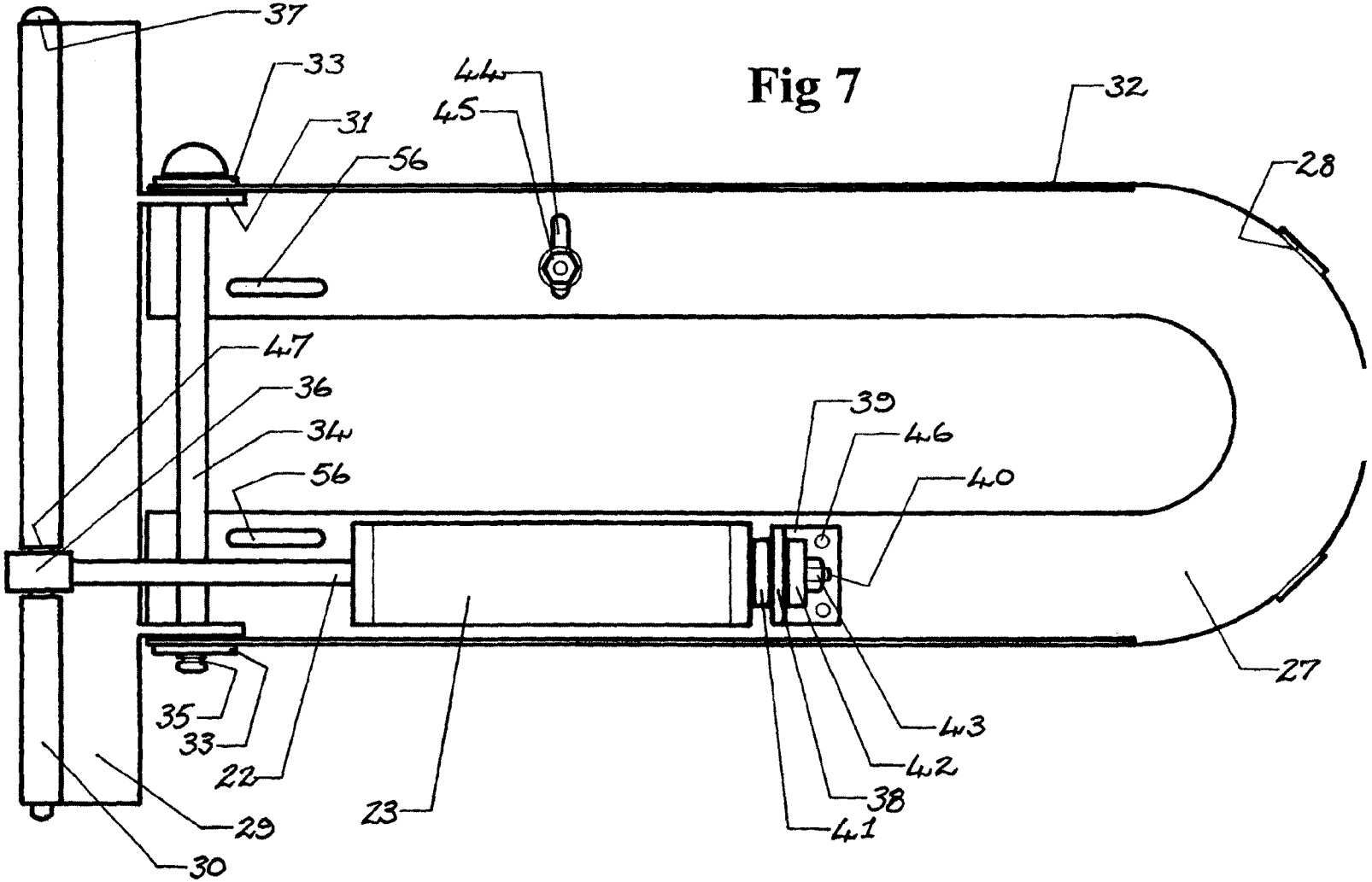
FIG. 7 is a plan view of another alternative embodiment of the trolling plate system of the present invention.

With additional reference to FIG. 7, attachment plate 27 is fixed to said anti-ventilation plate by a plurality of moveable clamps (not shown) supported by fastenings 45 passing downwardly through transversely arranged slots 44 (only one shown). Said clamps are positioned to engage the lower, side edges of said anti-ventilation plate and then are locked into position by tightening of said fastenings. In an alternative embodiment (not shown), said attachment plate is secured in place on said anti-ventilation plate by a plurality of tapered bolts. In this embodiment, L-shaped elements made from a solid metal material are fixed strongly to said attachment plate, said elements having a horizontal part abutting the upper surface of said attachment plate and a vertical part extending downwardly at the edges of said attachment plate. Suitably located, threaded apertures are provided in said vertical parts of said elements and bolts having tapered inner parts are screwed through said apertures such that their said tapered parts engage the lower edge surfaces of said anti-ventilation plate. Suitably located claws 28 are shaped to engage the leading edge of said anti-ventilation plate, said claws being created by turning tabs of suitable length and width downwardly through 180 degrees. In another alternative embodiment (not shown), a plurality of claws are provided along the side edges of said attachment plate to engage the side edges of said anti-ventilation plate. For stiffening purposes, the side edges 32 of said attachment plate are turned upwardly or downwardly through an angle of approximately 90 degrees. Said trolling plate is provided towards its upper end with pivot tabs 31 orientated normal to the generality of said plate. The trailing ends of side edges 32 are provided with bushed apertures 33. Said trolling plate is pivotally supported from said attachment plate by pivot bolt 34 passing through said pivot tabs and said bushed apertures, said pivot bolt being secured in place by a spring clip engaging groove 35 at its free end or by other suitable retaining means. Moveable clamps (not shown) are optionally provided to engage the trailing edge of said anti-ventilation plate, said clamps being supported by fastenings passing through longitudinally arranged slots 56 positioned towards the trailing end of attachment plate 27. Said clamps act to resist any reverse loadings applied to said trolling plate. In an alternative embodiment, downwardly projecting tabs are provided towards the trailing edge of attachment plate 27, said tabs being shaped and positioned to abut the trailing edge of said anti-ventilation plate when said attachment plate is in place on said anti-ventilation plate, thereby resisting any reverse loadings applied to said trolling plate. Deployment of said trolling plate is limited by its contact with the trailing ends of said attachment plate. In the preferred embodiment, said trailing ends of said attachment plate are turned through 90 degrees to provide a greater contact area with said trolling plate in its fully deployed position. With said trolling plate orientated vertically, its upper part 29 immediately above said pivot tabs is displaced rearwardly (away from said outboard motor) by an angle of 45 degrees and its upper edge is rolled into tubular form 30. Said rearwardly displaced part of said trolling plate acts as a lever and it, together with said rolled edge, also acts to stiffen said trolling plate against operationally imposed loadings. The head part 36 of rod 22 of actuator 23 is pivotally connected to said trolling plate by pivot bolt 37 passing through tubular form 30 and through said head part at cut-out 47 in said tubular form. In the preferred embodiment, said pivot bolt is frictionally retained in said tubular form. In an alternative embodiment (not shown), a suitable grub screw in head part 36 engages pivot bolt 37, thereby positively retaining said pivot bolt within said tubular form. Stud 40 at the fixed end of said actuator passes through elastomer bushes 41, 42 and through an aperture in the vertical part 38 of a bracket, the horizontal part 39 of which is fixed strongly to the upper surface of said attachment plate by rivets 46 or other suitable fastenings. Said aperture is sufficiently large to permit movement of said actuator with pivotal displacement of said trolling plate, said movement being accommodated by distortion of said elastomer bushes. With said trolling plate in its fully deployed position, progressive retraction of rod 22 into said actuator causes the rearwardly displaced upper part 29 of said trolling plate to be angularly displaced until, at a displacement of 90 degrees, said rod is fully retracted and said trolling plate is orientated horizontally. In the preferred embodiment, said trolling plate is ribbed or otherwise stiffened or reinforced to better accommodate operationally imposed loadings. Said trolling plate system is made from suitable corrosion-resistant materials.

Said actuator optionally takes the form of a hydraulic jack or an electromechanical actuator. The flow of hydraulic fluid to said hydraulic actuator is controlled by a three-position hydraulic valve and the flow of electrical current to said electromechanical actuator is controlled by a three-position switch. The use of either of said actuator form permits infinitely variable adjustment of the position of said trolling plate between its fully deployed and fully retracted positions. Said hydraulic actuator is supplied with a flow of hydraulic fluid by a small pump which is optionally electrically-operated or hand-operated. Said hand-operated pump is conveniently located clamped to the upper, inner edge of the transom of a boat adjacent said outboard motor. As the force required to displace said trolling plate to its fully deployed position is low, only low hydraulic pressures are required. In the preferred embodiment, said flow of hydraulic fluid is supplied to said actuator through a suitable flexible hydraulic line and via a shuttle valve at one end of which is a spring urging it into a position to connect said hydraulic pump to said actuator. At the other end of said shuttle-valve is a piston upon which hydraulic pressure in said hydraulic line acts, the force applied to said piston opposing that of said spring. Should high forces inadvertently be applied to said trolling plate, the hydraulic pressure rise generated in said actuator and said hydraulic line act to displace said piston and said shuttle valve, thereby dumping hydraulic fluid into a reservoir and permitting said actuator to move towards the retracted position of said trolling plate to relieve said high forces. In the preferred embodiment, the sensitivity of said shuttle valve is made adjustable through the use of screw means to increase or decrease the force of said spring. Where said actuator is electromechanical, a force switch is optionally provided at the outer end of said rod or at the pivotal attachment of said actuator. Said force switch takes the form of a small telescopic section, the two parts of which each contains an electrical contact, said contacts being normally maintained in separation by the urging of a spring. Should high forces inadvertently be applied to said trolling plate, the additional force applied to said force switch overcomes the urging of said spring and permits said electrical contacts to be made, closing a retraction circuit and thereby driving said actuator towards the retraction position until said high forces are relieved. Said force switch is preferably sealingly enclosed in a corrugated housing of a suitable durable elastomer.

Figure 6:
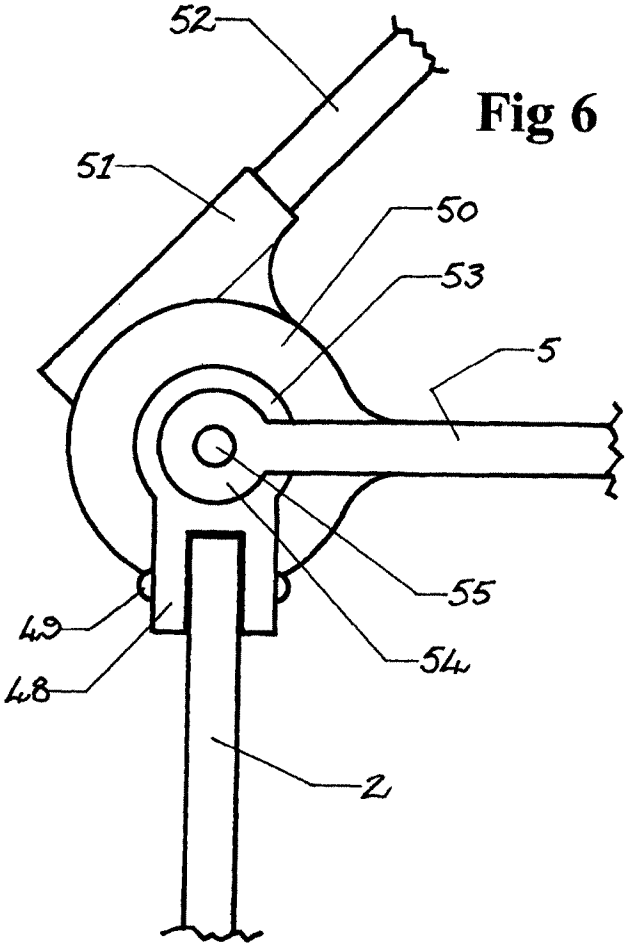
FIG. 6 is a fragmentary side view of means to displace a trolling plate of the present invention between its deployed and retracted positions.

With reference to FIG. 6, the trailing end of anti-ventilation plate 5 is formed at one side into housing 50 and, at the other side, into bearing 54. Tubular extension 51 of said housing contains a worm or rack (not shown) which engages a complementary gear of arcuate form (not shown) within said housing. Fixed to said arcuate gear is shaft 55 which turns in a bearing (not shown) in the wall of said housing and in bearing 54. Trolling plate support 53 is fixed to said shaft and the upper edge of trolling plate 2 is accommodated in channel 48 formed on said trolling plate support. Said trolling plate upper edge is retained in said channel by easily removable fastenings 49, the arrangement permitting the installation of trolling plates of different surface area. Flexible guide tube 52 extending from said tubular extension contains a flexible shaft (not shown) which is rotated or linearly displaced to cause rotation of said arcuate gear and, thereby, angular displacement of said trolling plate. Said flexible guide terminates, as appropriate, in a rotatable handle or lever (not shown) to displace said flexible shaft. In an alternative embodiment (not shown), said handle is relaced by a small, geared electric motor and said lever is replaced by a small, electrically-operated screw jack. Where said lever is employed, it is preferably provided with a detented quadrant to permit said lever to be positioned and locked in an intermediate position, thereby positioning said trolling plate intermediately between its fully deployed and fully retracted positions. In the preferred embodiment, said trolling plate displacement mechanism is fixed as an assembly to the trailing edge of said anti-ventilation plate or to said attachment plate following fixing of said attachment plate to said anti-ventilation plate.

Figure 8:
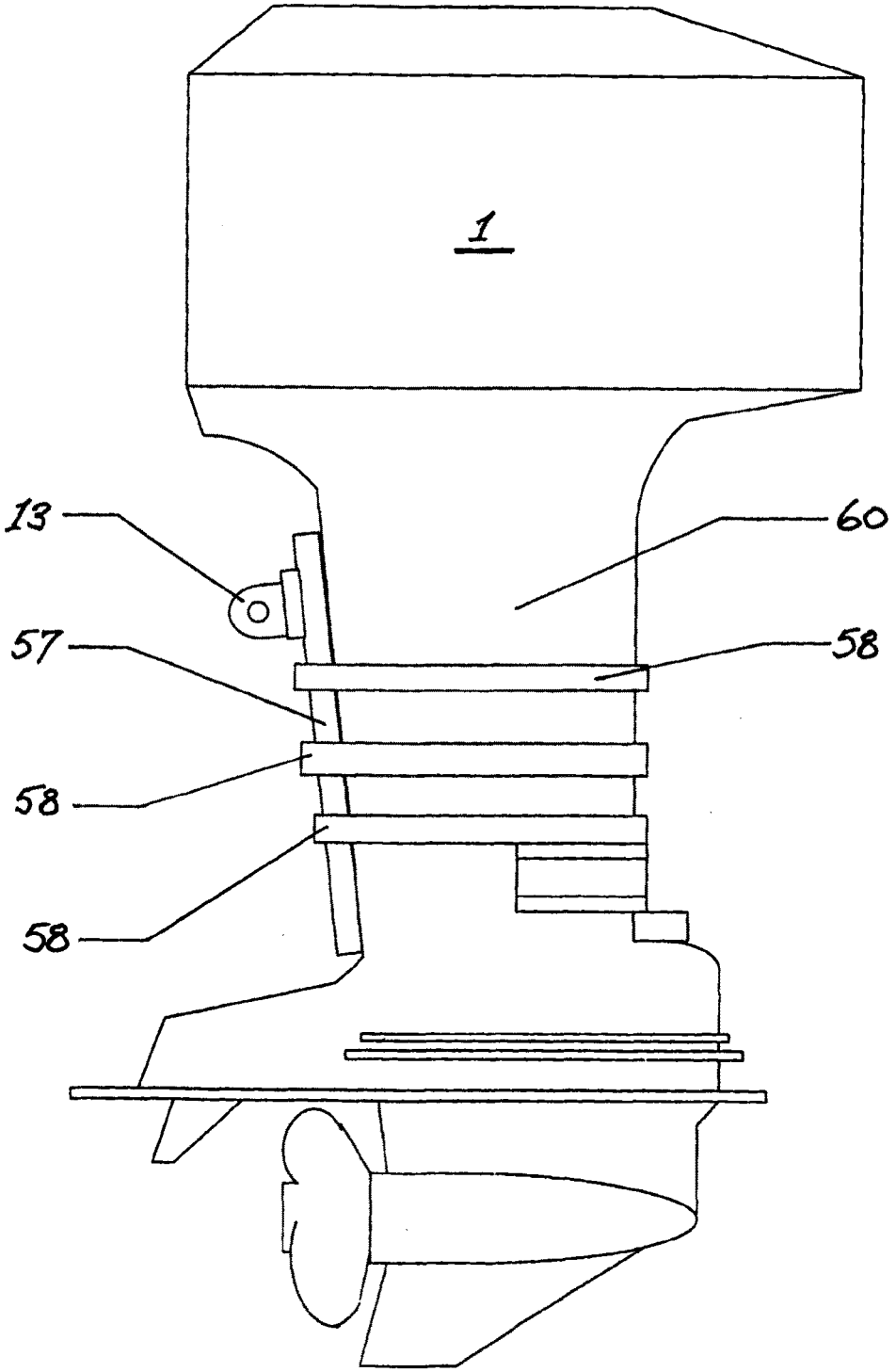
FIG. 8 is a side view of the outboard motor fitted with other alternative means to support an actuator of the trolling plate system of FIG. 1.

With reference to FIG. 8, actuator pivot 13 is fixed to attachment bar 57 which is, in turn, fixed to the trailing edge of mid section 60 of outboard motor 1 by means of one or more clamping bands 58. In the preferred embodiment, the inner surface of said attachment bar is shaped to conform to the external surface shaping of said trailing edge of said mid section.

Figure 9:
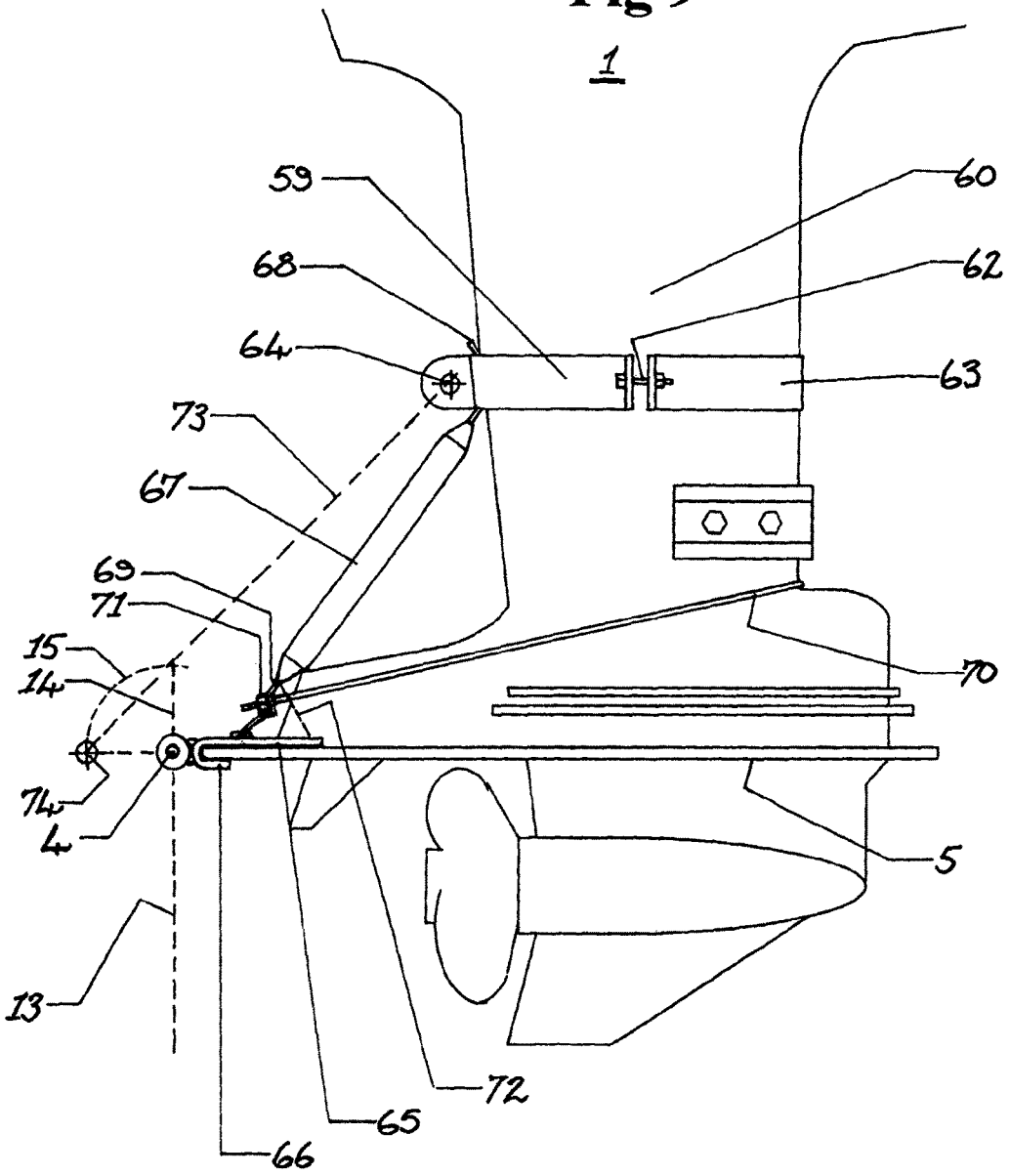
FIG. 9 is a side view of the outboard motor fitted with another alternative embodiment of the trolling plate system of the present invention.

With reference to FIG. 9, attachment plate 65 is supported upon the upper surface of the rear part of anti-ventilation plate 5, in the preferred embodiment, said attachment plate being shaped to conform to the shaping of said anti-ventilation plate upper surface. Suitably located claws 66 are provided on the trailing edge of said attachment plate, said claws and said attachment plate being optionally moulded in a single piece from a suitable engineering polymer material. In the preferred embodiment, said claws are formed by turning tabs of suitable width and length through 180 degrees, said claws being positioned and shaped to engage the trailing edge of anti-ventilation plate 5. In an alternative embodiment (not shown), one or more said claws are also provided on each side edge of said attachment plate, said claws engaging the side edges of said anti-ventilation plate. Trolling plate pivot 12 is optionally moulded integrally with said attachment plate at its trailing edge or is fixed by welding or other suitable method to said pivot plate trailing edge. Trolling plate (position depicted in broken line as 13) is pivotally supported on pivot 12. Lever arm (depicted in broken line as 14) is fixed to the pivotally supported end of said trolling plate. In the preferred embodiment, the leading edge of said attachment plate is cut away to created a medial aperture in which is accommodated the trailing edge of the fairing at the lower section of outboard motor 1 immediately above said anti-ventilation plate. A clamping band passing around mid section 60 of said outboard motor comprises leading part 63 and trailing part 59, said parts being drawn together by clamping bolts 62 at either side to tightly capture said mid section. Said clamping band trailing part supports upper actuator pivot 64. Strut 67 is preferably made in tubular form with flattened ends. The upper end 68 of said strut is bent over and captured beneath clamping band trailing part 59. The lower end of said strut is welded to said attachment plate. U-shaped tie bolt 70 is angled upwardly, passing around the leading edge of said outboard motor lower section with its free ends entered through suitable apertures provided in a short transverse bar (not shown) fixed to the bottom of said strut. Said tie bolt is tensioned to secure said attachment plate in place on said trailing edge of said anti-ventilation plate by suitable nuts 71 tightened onto threads provided on said free ends of said tie bolt. Actuator (position depicted in broken line as 73) is supported from said upper pivot and connected to pivot 74 at the free end of said trolling plate lever arm. Retraction of said actuator causes said trolling plate lever arm to be displaced through arc 15 (depicted in broken line), thereby causing said trolling plate to sweep through a similar arc. Stiffening gussets (depicted in broken line as 72) are optionally provided at either side of the lower end of strut 67 to brace said short transverse bar to said attachment plate. A soft polymer coating is optionally applied to the inner surfaces of components abutting surfaces of said outboard motor to avoid marring anodised surfaces. In the preferred embodiment, said actuator is connected to said upper pivot and said trolling plate lever arm pivot with ball lock-type quick-release pins for ease of removal. In an alternative embodiment (not shown) said tie bolt is replaced by a worm-tensioned strap. In another alternative embodiment (not shown), said tie bolt is positioned to pass along the surface of said anti-ventilation plate, said short transverse bar being deleted and said free ends of said tie bolt being entered through suitable apertures in lugs welded to said attachment plate.

In another alternative embodiment (not shown), said strut is duplicated, the lower ends of said struts being welded to either side of said attachment plate; and the upper ends of said struts being made joined and clamped in place by said clamping band or made separate and permanently fixed to either side of said clamping band trailing part by welding or removably fixed to said clamping band trailing part by threaded ends passing up through eyes fixed to said clamping band trailing part and secured by nuts. In another alternative embodiment, the lower end of a single said strut is bifurcated and welded to either side of said attachment plate. In another alternative embodiment (not shown), a transversely arranged bridge piece is welded to either side of said attachment plate and the lower end of said strut is welded to said bridge piece. In another alternative embodiment (not shown), the upper end of said strut is connected in common to pivot 64 with the upper end of said actuator, said strut being suitably cranked to take it clear of said actuator.

With reference again to FIG. 7, in an alternative embodiment, the trailing end of attachment plate 27 is made with a transversely arranged part forming a continuous piece with the two longitudinally arranged parts, said trailing end having suitably located claws of the type described in relation to FIG. 9. The arcuate leading end of said attachment plate is deleted and a short, U-shaped tie bolt is positioned passing around the leading edge of the lower section of said outboard motor with its free ends entered through suitable apertures in lugs welded to said attachment plate. Said tie bolt is tensioned to secure said attachment plate in place on said trailing edge of said anti-ventilation plate by suitable nuts tightened onto threads provided on said free ends of said tie bolt.

In another alternative embodiment (not shown), an adjuster is optionally provided at one end of said actuator, said adjuster incorporating a lockable cam arrangement or a lockable thread and nut arrangement.

In another alternative embodiment (not shown), a short, pivotally supported arm is provided on the floor of a boat, said arm terminating at its free, upper end in a textured foot pedal. The axis of motion of said arm is fore and aft, parallel to the longitudinal axis of said boat, pivotal displacement of said arm being limited to 90 degrees. Said arm moves between two arcuate guides, lower edges of either or both of which are serrated. Said arm is made telescopic, the two parts of which are urged into extension by a suitable internal spring, the sharp upper edge of a transversely arranged bar fixed to said telescopic upper part thereby being urged into contact with said arcuate guide serrated edges, locking said arm to said arcuate guides. Depression of said textured foot pedal by foot pressure disengages said sharp upper edge of said transversely arranged bar from said serrated edges of said arcuate guides, permitting said arm to be pivotally displaced. In a first embodiment, said arm is connected to said trolling plate by a suitable flexible cable and pivotal displacement of said foot pedal effects a change in the deployment angle of said trolling plate. In a second embodiment, angular displacement of said foot pedal operates a suitable transducer to generate a proportional electrical signal which is fed to a control system which controls said actuator to generate the same angular displacement of said trolling plate. In this last embodiment, said actuator generates a positional feedback signal which is also fed to said control system.

With reference again to FIG. 1, in another alternative embodiment (not shown), said trolling plate is fixed to a torque tube which is pivotally supported in pivots provided on the trailing edge of said attachment plate. Said lever arm is fixed to a shaft free to move inside said torque tube, said torque tube and the upper part of said trolling plate being cut away as required to permit an appropriate degree of independent movement of said arm. Fixed to the ends of said torque tube and said shaft are parallel plates upon which are supported complementary, sprung elements which lock said plates together. With said plates locked together, angular displacement of said lever causes simultaneous equal angular displacement of said trolling plate. Where a retraction force of predetermined magnitude is applied to said trolling plate whilst said lever is immobilised, said complementary, sprung elements are caused to disengage, permitting said trolling plate to freely move to a trailing position in which said loading is removed. Operation of said actuator to the fully retracted position of said trolling plate causes said complementary, sprung elements to re-engage, thereby permitting said trolling plate to be returned to its deployed position. In the preferred embodiment, said complementary, sprung elements take the form of rounded sprags, balls, rollers or the like.

Figure 11:
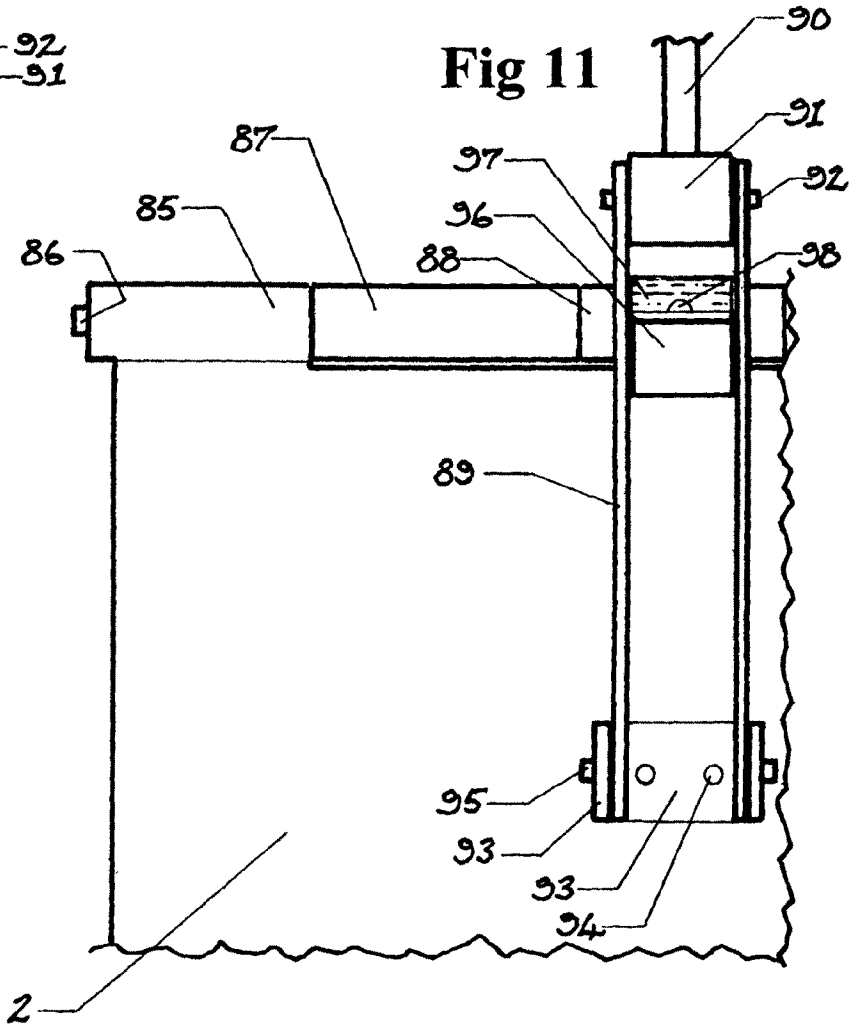
FIG. 11 is a fragmentary face view from the rear of the lever arm and trolling plate pivot assembly of FIG. 10.
Figure 10:
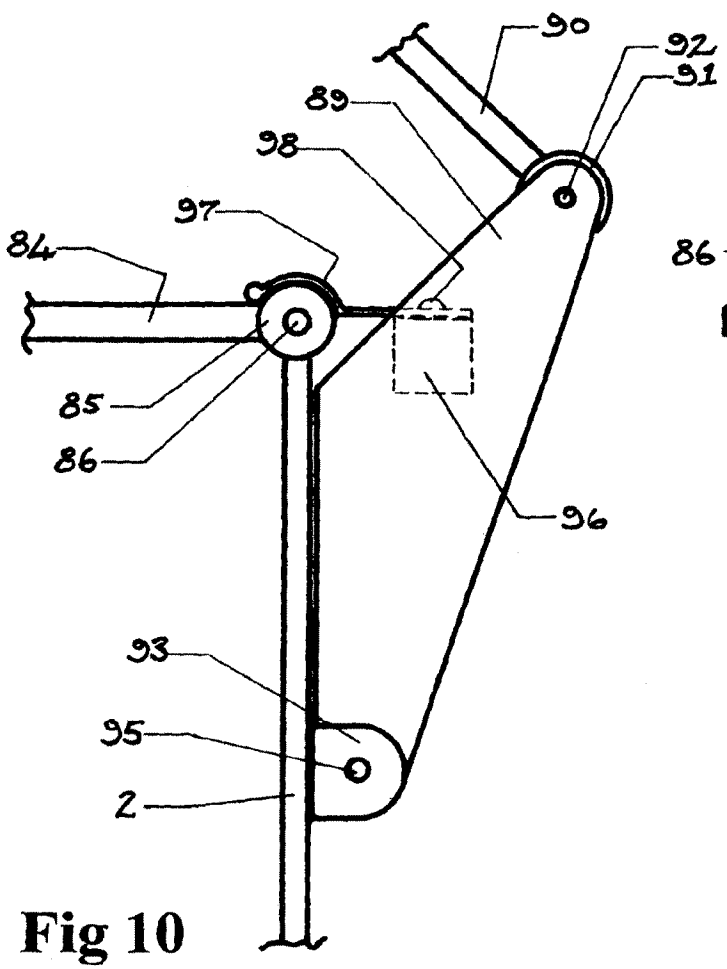
FIG. 10 is a fragmentary side view of a lever arm and trolling plate pivot assembly of an embodiment of the present invention.
Figure 13:
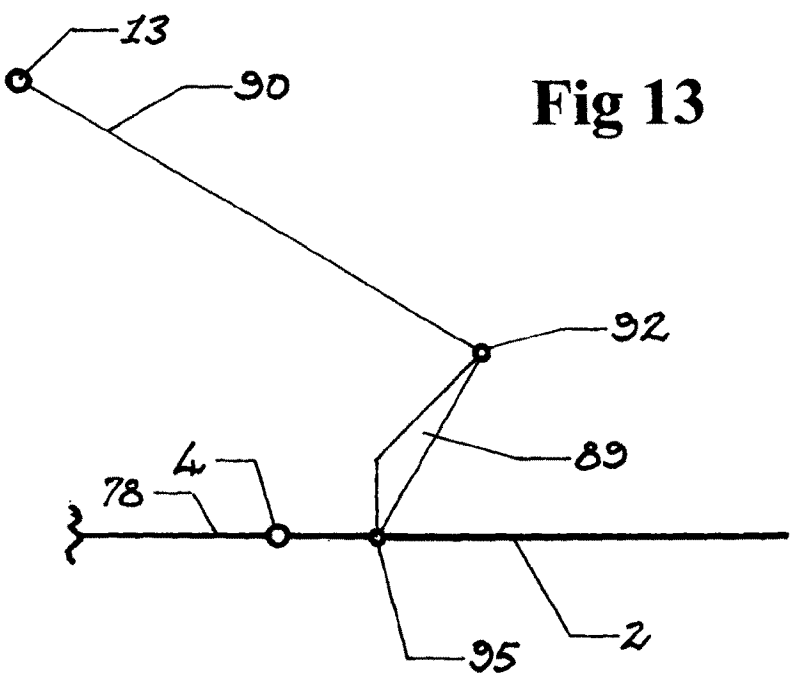
FIG. 13 is a kinematic schematic diagram of the lever arm and trolling plate pivot assembly of FIG. 10 depicting break-away of the trolling plate as a result of the application of excessive force.
Figure 12:
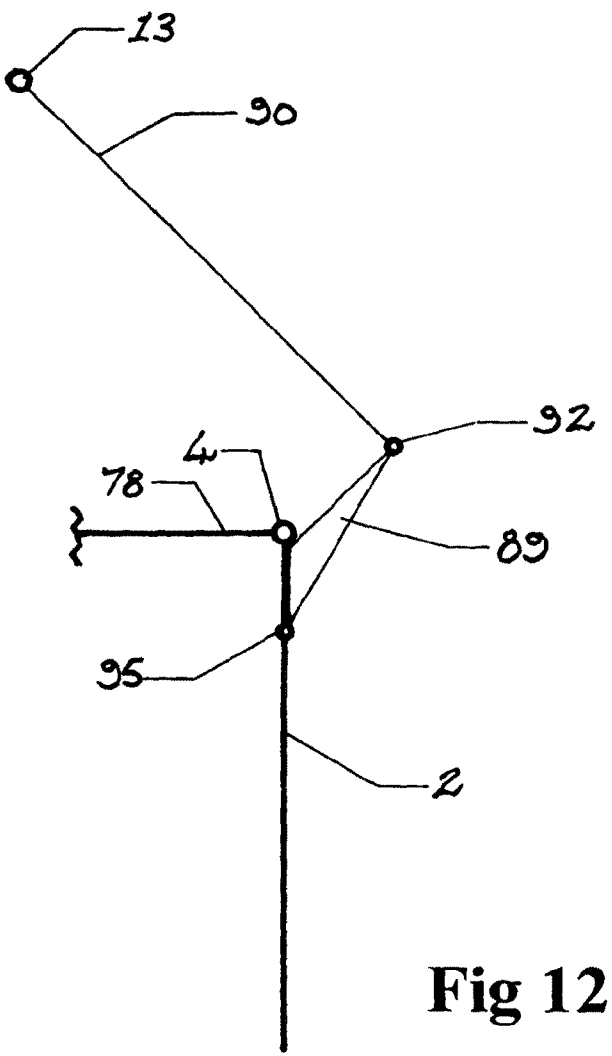
FIG. 12 is a kinematic schematic diagram of the lever arm and trolling plate pivot assembly of FIG. 10 in their normal operating positions.

With reference to FIGS. 10 and 11, lever arm 89 is pivotally attached to the upper/inner part of trolling plate 2 by pivots 95 fixed to the cheek plates of yoke 93 and passing out through complementary apertures in the lower/outer part of said lever arm. Said yoke is fixed to said trolling plate by means of suitable fastenings 94. In the preferred embodiment, said lever arm is made in a U-shaped cross-sectional shape by moulding from a suitable engineering polymer or by folding of a suitable metal alloy sheet material. Suitably positioned transverse bar 96 passes between the sides of said lever and is fixed to them. Said trolling plate is pivotally supported from attachment plate 84 by pivot bolt 86, said pivot bolt being carried in bearings 87 formed on the outer end of said attachment plate. Centrally located roller 88 is rotationally supported on said pivot bolt and is able to turn freely. Clip 97 of a suitably stiffly elastic material is fixed to said transverse bar by suitable removable fastenings 98 and positioned such that, when said lever arm abuts said trolling plate, a complementarily shaped part of said clip engages said roller. Engagement of said clip with said roller acts to restrain said lever arm in abutment with said trolling plate. The force of said engagement of said clip with said roller is set such that, when excessive force likely to incur damage is applied to said trolling plate, said clip disengages from said roller, freeing said trolling plate from the restraints of its actuator (not shown) applied through rod 90, permitting said trolling plate to pivot freely to its retracted position and thereby relieving said excessive force. The force of engagement of said clip with said roller is varied by substituting said clip with another made with a greater or lesser thickness or width or from stronger or weaker material. With additional reference to FIG. 12, the situation depicted in FIG. 10 is depicted in schematic form with trolling plate 2 in its fully deployed position with lever arm 89 held in abutment with said trolling plate by the engagement of said clip with said roller. With additional reference to FIG. 13, excessive force has disengaged said clip from said roller, said lever arm has been pivotally displaced on pivot 95 permitting trolling plate 2 to pivot to its retracted position, and actuator and rod 90 have been pivotally displaced on actuator pivot 13.

In an alternative embodiment (not shown), said spring clip is deleted and suitable magnets of complementary polarity are fixed to said trolling plate and to said lever arm to restrain said components in abutment, said magnets disengaging when excessive force is applied to said trolling plate. The force of attachment of said lever arm to said trolling plate is varied by substituting magnets of greater or lesser size or strength. In another alternative embodiment (not shown), said trolling plate and said lever arm are restrained in abutment by, the joining of complementary coupling parts by means of a frangible pin, said pin rupturing when excessive force is applied to said trolling plate. The force of attachment of said lever arm to said trolling plate is varied by making said frangible pin hollow with greater or lesser wall thickness or by making it from a weaker or stronger material. In another alternative embodiment (not shown), said trolling plate and said lever arm are restrained in abutment by the entry of a latching member fixed to one between opposed pairs of sprung balls or other sprung elements of a coupling fixed to the other, said sprung elements engaging detents in said latching member and disengaging when excessive force is applied to said trolling plate. The force of attachment of said lever arm to said trolling plate is varied by increasing or decreasing the force of the impelling springs of said sprung elements. When excessive force applied to said trolling plate has caused said lever arm to pivotally separate from said trolling plate, in embodiments in which said trolling plate and said lever arm are restrained in abutment by a frangible pin, said pin must be replaced. In embodiments in which said trolling plate and said lever arm are restrained in abutment by magnetic means, sprung latch means or sprung clip means, operation of said actuator to the fully retracted position of said trolling plate causes the re-engagement of said restraining means.

Figure 14:
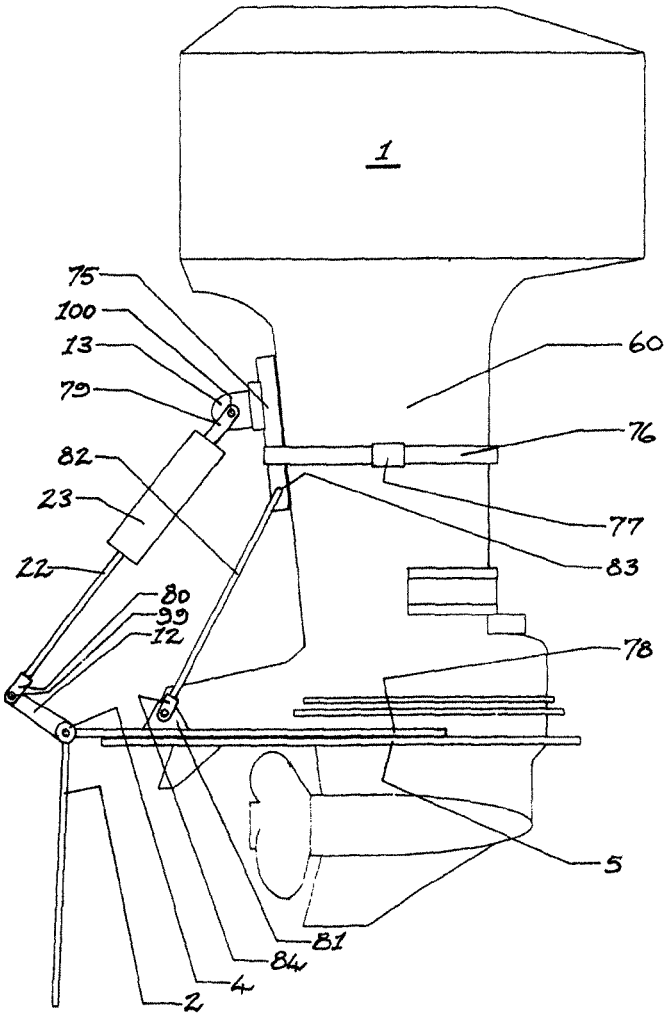
FIG. 14 is a side view of an outboard motor fitted with other alternative means to support an actuator of the trolling plate system of FIG. 1.

With reference to FIG. 14, actuator pivot 13 is fixed to or incorporated into attachment block 75 which is, in turn, fixed to the trailing edge of mid section 60 of outboard motor 1 by means of clamping band 76. In the preferred embodiment, the inner surface of said attachment block is shaped to conform to the external surface shaping of said trailing edge of said mid section. Also in the preferred embodiment, a suitable elastomeric material is inserted between said clamping band and said outboard motor mid section and between said attachment block and said mid section and said clamping band is tensioned by over-centre clip 77. Also in the preferred embodiment, said attachment block is cut away and rounded to accommodate and locate said clamping band and to eliminate sharp bends at the edges of said block. Attachment plate 78 is fixed to anti-ventilation plate 75 by any of the methods described herein and trolling plate 2 is pivotally supported at the free end of said attachment plate on pivot 4. Lever arm 12 is fixed to the pivot end of said trolling plate and clevis 80 of rod 22 of actuator 23 is pivotally connected to the free end of said lever arm by pivot pin 99. Clevis 100 on the upper end of said actuator is pivotally connected to said actuator pivot by pivot pin 100. Struts 82 fixed to the lower side parts of said attachment block and to lugs 81 fixed to the side edges of said attachment plate act to locate said attachment block and support it against forces generated by said actuator. In an alternative embodiment, said struts are formed from a single piece of rod material, passing through a bore formed in the lower part of said attachment block. Said lugs are optionally formed on said attachment plate when said attachment plate is moulded from a suitable engineering polymer material, or are welded to the side edges of an embodiment of said attachment plate made from a suitable metal alloy material, or are made integral with said attachment plate when its sides are turned upwardly for stiffening purposes.

Figure 15:
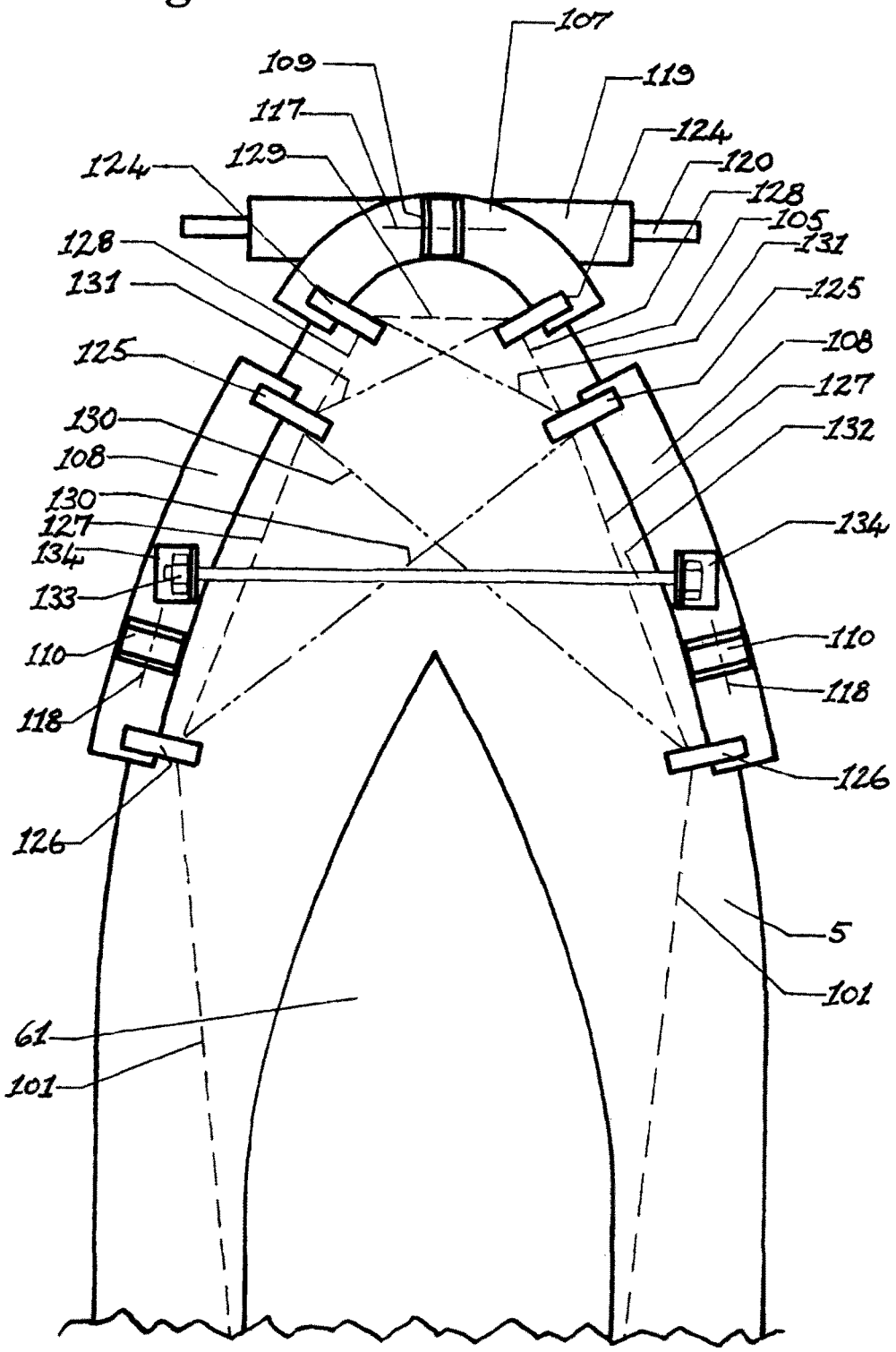
FIG. 15 is a partial plan view of an alternative embodiment of means to support the trolling plate system of the present invention.
Figure 16:
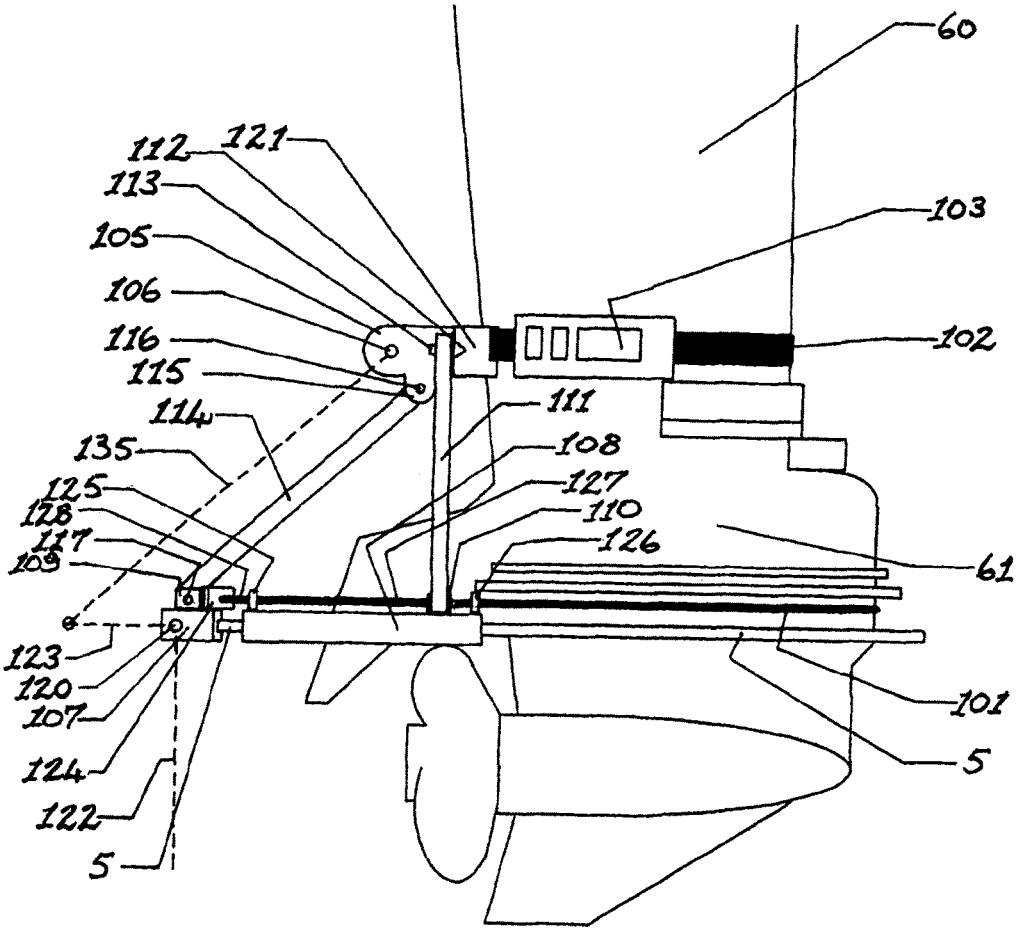
FIG. 16 is a partial side view of the embodiment of FIG. 15.

With reference to FIGS. 15 and 16, said attachment plate takes the form of three discrete pieces 107, 108, 108, said pieces being shaped as required to fit, respectively, the aft-most and aft lateral parts of anti-ventilation plate 5. In the preferred embodiment, the inner edges of said pieces are made with channels in which the edges of said parts of said anti-ventilation plate are accommodated. In an alternative embodiment (not shown), said inner edges of said pieces are provided with a plurality of claws which engage said parts of said anti-ventilation plate. Piece 107 incorporates a transversely arranged strut 119 on the ends of which are formed pivots 120 for the pivotal support of said trolling plate (deployed position depicted in broken line as 122 in FIG. 16). Sockets 109, 110, 110 are provided respectively fixed to the upper surfaces of pieces 107, 108 and 108. Actuator supporting block 121 is supported on the trailing edge of mid section 60 of said outboard motor by supporting band 102 tightened around said mid section by over-centre clamp 103. Lug 105 formed on said supporting block supports pivot 106 which pivotally supports the upper end of a suitable actuator (typical position depicted in broken line as 135 in FIG. 16). A trolling plate (deployed position depicted in broken line as 122 in FIG. 16) is pivotally supported on pivots 120 of said transversely arranged strut incorporated into piece 107. The lower end of said actuator is pivotally connected to the free end of a lever arm fixed to the pivot end of said trolling plate (deployed position depicted in broken line as 123 in FIG. 16). The upper ends of a pair of angled struts 111 are pivotally connected to face 112 formed on actuator supporting block 121 by pivots 113. The lower ends of said struts engage and make a tight fit with sockets 110, 110 and are secured thereto by pins (positions indicated in broken line as 118 in FIG. 15). Said struts act to restrain pieces 108, 108 against fore and aft displacement. The upper end of angled strut 114 is pivotally connected to lug 115 formed on the lower face of actuator supporting block 121 by pivot 116. The lower end of said strut engages and makes a tight fit with socket 109 and is secured thereto by a pin (position indicated in broken line as 117 in FIG. 15). Said strut acts to restrain piece 107 against lateral displacement. In the preferred embodiment, all of said pins and pivots take the form of quick-release ball-lock pins. Also in the preferred embodiment, the angle of face 112 and the positioning of said sockets are such that struts 111 are inclined downwardly and rearwardly at an angle in the range 5° to 30° from the vertical. Also in the preferred embodiment, the ends of piece 107 are rounded and abut adjacent rounded ends of pieces 108, 108 when said pieces are assembled in place on said anti-ventilation plate. Lugs 124 are fixed at each end to the upper surface of piece 107 and lugs 125, 126 are fixed at each end to the upper surfaces of pieces 108, 108. A cord or cable 101, 127, 128, 129, 128, 127, 101 is passed through suitable apertures in said lugs and tensioned by suitable means (not shown), the tension of said cord or cable acting to secure said pieces in place on said anti-ventilation plate. The lower ends of struts 111, 111, 114 are preferably entered into their respective said sockets and secured with said pins prior to tensioning of said cord or cable. In an alternative embodiment, said cord or cable is threaded through said apertures in said lugs in the pattern 101, 130, 131, with the ends terminating at lugs 124. Obviously, said cord or cable must pass clear of lower part 61 of mid section 60 of said outboard motor. In an alternative embodiment, one or more tie bolts 132 are provided passing transversely between pieces 108, 108, the ends of said tie bolts passing through brackets 134, 134 fixed to the upper surfaces of said pieces and being tensioned by the tightening of nuts 133. In an alternative embodiment (not shown), said tie bolts pass beneath said anti-ventilation plate. The arrangement described permits a trolling plate and actuation means to be fitted to an unmodified outboard motor with the use only of simple hand tools.

In all said embodiments, said actuator is controlled by means of a three-position electrical switch or a three-position hydraulic valve. Said electrical switch is preferably mounted on the upper part of said outboard motor, in a convenient position on the inner surface of the transom of the boat or on the steering wheel of the boat. Said hydraulic valve is preferably mounted adjacent the steering position of the boat close to the throttle control or in a convenient position on the inner surface of the transom of the boat. Where an electronic control system is employed to control the position of said trolling plate via an electromechanical actuator, said control system receives position command signals from a control lever and positional feedback signals from said actuator. Said control lever is universally variable over a range corresponding to full deployment to full retraction of said trolling plate and operates a suitable transducer to generate said position command signals. Said positional feedback signals are optionally also supplied to a trolling plate position indicator. Said control system optionally continuously monitors signals relating to engine RPM and/or throttle position and/or reverse-ahead shift control and, in response to change exceeding a predetermined value, immediately operates said actuator to displace said trolling plate to its fully retracted position.

In an alternative embodiment (not shown), the flexible core of a Bowden-type cable terminates at a suitable quadrant which is fixed to and rotates with the supporting shaft of a trolling plate, said flexible core being conducted via a suitable sheath to position indicating means mounted on the inner surface of the transom of a boat or adjacent the steering position. The ends of said sheath are permanently fixed adjacent said quadrant and said position indicating means. Angular displacement of said trolling plate results in displacement of said flexible core and, thereby, a commensurate change in said position indicating means.

In another alternative embodiment (not shown), rotation motion of the supporting shaft of a trolling plate is, communicated to a suitable transducer, the signal so generated being transmitted by electrical conductors to position indicating means mounted on the inner surface of the transom of a boat or adjacent the steering position. The signal change caused by angular displacement of said trolling plate results in a commensurate change in said position indicating means.

In an alternative embodiment (not shown), an automatic speed control system for a boat is provided, based upon a suitable field-portable microprocessor-based control unit. Instantaneous boat speed detected by means of a global positioning system readout or water speed measurement device is compared in said control unit to a previously entered speed command signal. The boat engine is set at a constant RPM and the control unit responds to any deviation from said speed command by deploying said trolling plate to a greater or lesser extent in accordance with a speed-control algorithm. In the preferred embodiment, said water speed measurement device takes the form of a sprung arm temporarily deployed from the bow of the boat and supporting at its lower end an immersed disc. Said arm is pivotally supported, its single axis of freedom being in a vertical plane parallel to the longitudinal axis of the boat, a spring continuously urging said arm forwardly. According to the speed of the boat through the water, drag of said disc causes said arm to be displaced rearwardly against the urging of said spring, thereby causing a transducer at the point of suspension of said arm to generate a speed signal. To minimise wave effects, the immersed part of said sprung arm is preferably made with minimum lateral width and with a hydrodynamically efficient cross-sectional shape. Similarly, the length of said arm is such as to provide a depth of immersion of said disc sufficient to minimise wave effects.

In an alternative embodiment (not shown), said trolling plate is extended and retracted by means of a hydraulic actuator. A flow of hydraulic fluid is supplied to or withdrawn from said actuator by means of a hydraulic displacement unit. Said hydraulic displacement unit comprises a piston displaced in a cylinder by screw means operated by a suitable electric motor. Said hydraulic actuator and said hydraulic displacement unit are connected by a single flexible hose and movement of said piston in said displacement unit is reflected in a concomitant movement in said hydraulic actuator. The hydraulic pressures generated during deployment or retraction of said trolling plate are low and the pistons of said hydraulic actuator and said hydraulic displacement unit are provided with seals capable of sustaining positive and negative pressures. Trolling plate positional data is generated by linear magnetic means incorporated into said cylinder of said hydraulic displacement unit or by rotor and pulse counting means incorporated into said electric motor.

In another alternative embodiment (not shown), actuation means to displace said trolling plate are controlled by means of a remote control unit transmitting radio-frequency signals, such control units being well known in the art. Said control unit optionally incorporates separate 'Extend' and 'Retract' buttons and an operator simply depresses the appropriate button and observes said position indication means, releasing said button when the desired displacement has been achieved. Alternatively, said control unit incorporates a trolling plate position selector. An operator uses said position selector to select a desired position of said trolling plate and said control unit transmits coded impulses to operate said actuation means in the appropriate sense until feedback signals indicate achievement of the desired displacement.

The present invention should be taken to encompass any practical combination of any one or more described features with any one or more other described features.

The invention claimed is:

1. A trolling plate assembly comprising:

an attachment plate shaped to mount on a boat motor having a propeller;

an electric actuator;

a trolling plate pivotally attached to the attachment plate and attached to the electric actuator such that the trolling plate is movable between an extended, substantially vertical position adjacent the propeller and a retracted, substantially horizontal position in response to movement of the electric actuator; and an automatic speed control system for a boat that compares an instantaneous boat speed to a previously entered speed command signal and deploys said trolling plate to a greater or lesser extent by driving the electric actuator in accordance with a speed-control algorithm and a difference between the instantaneous boat speed and the previously entered speed command signal.

2. The trolling plate assembly of claim 1 in which said electric actuator has a downwardly-angled disposition with one end of the electric actuator being pivotally connected to a lever arm fixed to an edge of said trolling plate.

3. The trolling plate assembly of claim 1 in which said electric actuator has a horizontal disposition with one end of the electric actuator being pivotally connected to a lever arm fixed to an edge of said trolling plate, said the electric actuator being supported from an anti-ventilation plate of said outboard motor by pillars.

4. The trolling plate assembly of claim 3 in which the attachment plate is attached to the anti-ventilation plate of the motor and said pillars are fixed to the anti-ventilation plate by one of fixed jaws positioned over the side of said anti-ventilation plate and secured to it with grub screws or moveable jaws positioned over the side of said anti-ventilation plate and tightened by screws.

5. The trolling plate assembly of claim 1 in which said trolling plate is ribbed.

6. The trolling plate assembly of claim 1 further comprising a controller having a selector in which the selector comprises a three-position switch, permitting variable adjustment of the position of said trolling plate between the extended position and the retracted position.

7. The trolling plate assembly of claim 1 in which an adjuster is provided at one end of said electric actuator, said adjuster incorporating a lockable cam arrangement or a lockable thread and nut arrangement.

8. The trolling plate assembly of claim 1 in which said automatic speed control system continuously monitors signals relating to at least one of engine RPM, throttle position, and reverse-ahead shift control and based on the monitored signals operates said electric actuator to displace said trolling plate to its retracted position.

9. The trolling plate assembly of claim 1 further comprising a controller comprising separate 'Extend' and 'Retract' buttons and a position indicator.

10. The trolling plate assembly of claim 1 further comprising a controller in which said controller incorporates a trolling plate position selector and said controller receives feedback signals indicating a position of the trolling plate, wherein said controller transmits signals to operate said electric actuator until the feedback signals indicate achievement of a desired displacement of said trolling plate indicated by the trolling plate position selector.

11. The trolling plate assembly of claim 1, further comprising:

a retraction circuit to effect immediate retraction of said trolling plate to the retracted position as a result of forces being applied to the trolling plate, wherein the retraction circuit comprises a force switch comprising first and second electrical contacts, wherein in response to the force applied to the trolling plate, the force switch closes the first and second electrical contacts, causing the retraction circuit to drive the electric actuator toward the retracted position.

12. The trolling plate assembly of claim 11 wherein the speed control system comprises a controller having a selector that when selected causes the controller to send a signal to the electric actuator to change the position of the trolling plate allowing reinstatement of said trolling plate to the extended position after the retraction circuit retracted the trolling plate.

13. The trolling plate assembly of claim 1 in which said electric actuator is angled in the extended and retracted positions relative to horizontal, with one end of the electric actuator being pivotally connected to a lever arm fixed to an edge of said trolling plate.

* * * * *